US008863954B2

(12) United States Patent
McCormick et al.

(10) Patent No.: US 8,863,954 B2
(45) Date of Patent: Oct. 21, 2014

(54) CUPS THAT ADD COLOR TO LIQUID CONTENT AND METHODS OF MANUFACTURING THE SAME

(76) Inventors: Brian McCormick, Mableton, GA (US); Brannon McKay, Marietta, GA (US)

( * ) Notice: Subject to any disclaimer, the term of this patent is extended or adjusted under 35 U.S.C. 154(b) by 414 days.

(21) Appl. No.: 13/098,422

(22) Filed: Apr. 30, 2011

(65) Prior Publication Data

US 2012/0273507 A1 Nov. 1, 2012

(51) Int. Cl.

| | |
|---|---|
| ***B65D 85/62*** | (2006.01) |
| ***B65D 1/26*** | (2006.01) |
| ***B31B 1/00*** | (2006.01) |

(52) U.S. Cl.

CPC . *B31B 1/00* (2013.01); *B65D 1/265* (2013.01); *B31B 2217/062* (2013.01); *B31B 2201/90* (2013.01); *B65D 2203/00* (2013.01); *Y10S 215/08* (2013.01)

USPC ..... 206/515; 206/219; 215/DIG. 8

(58) Field of Classification Search

USPC ..... 220/62.12, DIG. 12, 575; 206/219, 0.5, 206/516, 519, 515; 426/250, 86, 262; 118/30, 264, 270, 26, 13; 215/DIG. 8

See application file for complete search history.

(56) References Cited

U.S. PATENT DOCUMENTS

| | | | | | |
|---|---|---|---|---|---|
| 2,062,897 | A | * | 12/1936 | Michel et al. | 426/86 |
| 3,135,118 | A | | 6/1964 | Zlobin | |
| 3,186,850 | A | * | 6/1965 | Anthony | 426/86 |
| 3,202,275 | A | | 8/1965 | Loughary | |
| 3,260,690 | A | | 7/1966 | Bohnert | |
| 3,278,014 | A | * | 10/1966 | Thornton | 206/217 |
| 3,696,987 | A | | 10/1972 | Schuff | |
| 4,312,889 | A | | 1/1982 | Melsheimer | |
| 4,884,717 | A | * | 12/1989 | Bussard et al. | 220/229 |
| 4,967,687 | A | * | 11/1990 | McShane | 118/13 |
| 6,705,491 | B1 | | 3/2004 | Lizerbram | |
| 2005/0242103 | A1 | | 11/2005 | Thomas | |
| 2007/0262042 | A1 | | 11/2007 | Pareja | |
| 2008/0084915 | A1 | | 4/2008 | Gluck | |

* cited by examiner

*Primary Examiner* — Jeffrey Allen

(74) *Attorney, Agent, or Firm* — Apex Technology Ventures, LLC

(57) ABSTRACT

Cups that color liquid contents and methods of manufacturing the same are disclosed herein. The cups include an inner wall with a colorant disposed and affixed therein. The colorant is predisposed (i.e., affixed) before the introduction of a liquid, and remains affixed until a liquid is introduced into the cup. The colorant can be disposed within a recess. The colorant can also be affixed to a first cup such that stacking an identical cup within the first cup does not result in the colorant touching the identical cup.

7 Claims, 6 Drawing Sheets

CUPS THAT ADD COLOR TO LIQUID CONTENT AND METHODS OF MANUFACTURING THE SAME

DESCRIPTION OF THE EMBODIMENTS

1. Field of the Embodiments

The embodiments relate generally to cups, and, more specifically, to cups that add color to liquid content that is poured into the cups and methods for manufacturing the cups.

2. Background

The idea of adding colorant to liquid is not new. For example, on St. Patrick's Day, some bars manually add green food coloring to otherwise normal beer so that the liquid appears green in the mugs of patrons. During the celebration, the city of Savannah, Ga., goes so far as to add green coloring to a local river to make it appear green. Similarly, anyone can manually add food coloring to yellow lemonade to make it appear pink.

Under prior methods, drinks have been colored in a couple ways. One way is by adding food coloring to a large quantity of liquid before it is dispensed into a cup. Continuing with the St. Patrick's Day example, a bar can add green food coloring to several kegs of beer. One problem with this approach is that if the color of the beverage (in this example, green beer) is only desirable for a limited time (e.g., St. Patrick's Day or a sports game), then coloring large quantities of beverage can result in waste if the beverage is not consumed before the limited time expires. For example, after St. Patrick's Day ends, most patrons will prefer regularly-colored beer over green beer. In short, coloring large quantities of beverage decreases the time frame in which the beverage can be sold or consumed.

Another common method of coloring drinks involves manually adding food coloring directly to each cup of liquid at the time the drink is poured into the cup. One advantage of this approach is that vendors do not need to commit large quantities of drink product (or bar taps) to the color, and can still sell the originally colored beverages to customers that want it. But this approach has its own set of problems, including adding an additional step to beverage creation, additional inventory readily available to the server (i.e., the food coloring), and the potential for additional mess. These problems make the drink-by-drink approach unrealistic to implement during sporting events. For example, most fans want to get their drinks as quickly as possible so they can resume watching the game. The aggregate effect of manually coloring each fan's drink could be costly, since customers will go to other vendors with shorter lines or avoid buying a drink altogether. Similarly, at a baby shower or some other party, the host rarely has time to custom color each person's drink, and would likely not trust guests to do it themselves.

Because of these and other drawbacks of current methods, custom-coloring drinks is not a common practice in households or commercial ventures (e.g., amusement parks or sports arenas). Instead, stadium vendors typically settle for cups that include graphics of the home team, but rarely ever color the liquid in the cups to match the colors of the home team. Additionally, someone throwing a birthday party would probably not take the time to add dye to the drinks to match the birthday child's favorite color.

Other inventions exist for coloring drinking liquid, but they all fall short of addressing these problems or teaching aspects of the embodiments disclosed herein. For example, U.S. Patent Pub. No. 2007/0262042 ("Pareja") discloses a tamper-preventing liquor bottle that dispenses a harmless dye when someone attempts to tamper with (e.g., dilute) the contents of the bottle. The invention in Pareja involves a valve in the bottle that dislodges and physically drops into the liquid when tampering occurs. This invention does not address the problems raised above, nor does it apply in any way to cups. Indeed, it is completely silent with regard to cups. This is expected, since the anti-tampering bottle valve of Pareja would severely limit a person's ability to drink from the cup, and its implementation would be too expensive and complicated for one-time uses in a cup. Additionally, people generally do not want to see a foreign physical object, such as a valve, floating (or sunken) in their cup.

Bottle caps and lids with chambers for mechanically releasing elements into bottles have also been attempted. For example, U.S. Pat. No. 6,705,491 ("Lizerbram") discloses a special cap (or "closure element") that includes a chamber that can contain a colorant. The cap is fitted to a "beverage container," and can be manually manipulated to release the colorant from the chamber and drop it into the beverage container. U.S. Pat. No. 6,224,922 ("Fonte") contains similar disclosures. Tellingly, these patents are silent with regard to cups, and instead implement lids with chambers for mechanically releasing colorants into bottles.

A colorant-dispensing lid, as disclosed for bottles, would be undesirable for cups for several reasons. For example, the presence of a lid on some drinks, such as on a cup beer, is socially awkward and would not be desirable in a home or commercial setting. Certainly, in the St. Patrick's Day example above, a bar would not want to serve its patrons mugs of beer with lids on them. Additionally, attaching these lids can be a waste of time when serving patrons or guests and can be a nuisance to those who wish to drink from the cup without a lid. In some cases the patron would need to manually manipulate the chamber to release the colorant, which adds further inefficiency. Moreover, the requirement of a lid with a special chamber represents a substantial manufacturing cost compared to a cup with no lid or with a normal lid.

Colored plastic cups are commonly used, but they do not color the liquid poured into the cups. Other cups, such as described in U.S. Patent Pub. No. 2005/0242103 ("Thomas") and U.S. Pat. No. 5,156,365 ("Heinmets"), include a thermochromatic substance in the walls of the cup that changes color based on the temperature of the liquid poured into the cup. But this substance is isolated from the cup contents, and does not change the color of the liquid poured into the cup.

Therefore, a need exists for easily, cleanly, and cheaply coloring liquids in cups. Accordingly, cups are described herein that color liquid that is poured into them. Methods of manufacturing the cups are also described herein.

SUMMARY

Based on at least the above shortcomings of prior beverage coloring methods, new ways have long been needed to color liquid beverages contained in cups. Disclosed herein are several embodiments of cups that color beverages poured into them in a manner that is advantageous over prior methods. The embodiments also include novel methods of manufacturing the novel cup products that actually color the drinking liquid that is poured into them.

More particularly, embodiments disclosed herein include cup products that include a colorant substance disposed (i.e., affixed) on an inner surface of the cup. The colorant is affixed as part of the cup, added independently of whatever liquid is eventually poured into the cup. When a liquid drink is poured into the cup and comes into contact with the colorant, the colorant dissolves into the liquid, thereby coloring the liquid.

By providing the colorant as a part of the cup, the liquid can be colored efficiently without any extra steps beyond pouring the liquid into the cup.

Additionally, in one embodiment, the colorant, prior to the addition of liquid, is completely contained within a recess, such that it does not touch any surface of another identically dimensioned cup when the cups are stacked within each other. In this way, multiple cups can be stacked within each other with substantially no colorant transfer, which prevents colorant from getting on a user's hand, among other messes. In one implementation, this is achieved by creating a recess in a cup surface, wherein the recess width in the inner surface is less than a corresponding bulge width on the outer surface opposite the recess, if a bulge exists. In another implementation, the outer surface opposite the recess is substantially flat.

In one aspect, the recess is on the bottom of the cup, inside the cup. Alternatively, the recess may extend vertically up the inner wall of the cup, such that the amount of colorant released into the liquid varies proportionally to the amount of liquid poured into the cup. In this way, the color concentration of the liquid can remain relatively consistent between cups that are filled to different levels. In another aspect, the vertical recess is a groove with a width that is greater at a first level than at a second level, wherein the first level is higher than the second level. In this way, the groove can hold more colorant at the first level (i.e., closer to the top of the cup) than at the second level, for example, to facilitate a more uniform colorant distribution in a cup with a greater diameter at the top of the cup than at the bottom of the cup (e.g., a cup with more liquid-holding capacity towards the top of the cup).

In another embodiment, at least one surface of the cup is transparent such that the color of the colorant can be seen from the outside of the cup. The colorant may, in one aspect, show through the transparent surface of the cup to form a logo or some other marking.

In still another embodiment, the colorant is a first color and the exterior of the cup includes a second color, wherein the first and second colors are team colors of a sports team. In another embodiment, the colorant is set to turn the liquid the first color, wherein the combination of the colored liquid and the second color are team colors of a sports team.

In yet another embodiment, the colorant includes a plurality of colors that are released at least partially in order, rather than simultaneously. This aspect may include first and second complimentary colors that, when blended, change the color of the liquid to a third color.

Embodiments herein also include methods of manufacturing a cup that includes colorant. The methods include molding a cup with a recess, and placing colorant in the recess. In one embodiment, a disk of colorant is pressed into a moldable substance to form the recess around the colorant. In another embodiment, the colorant is sprayed into the recess. Further, the spraying may occur when the moldable substance is less than 90% cured, thereby increasing the adhesion of the colorant to the moldable substance upon full curing of the cup.

Additional objects and advantages of the embodiments will be set forth in part in the description which follows, and in part will be obvious from the description, or may be learned by practice of the embodiments. The objects and advantages of the embodiments will be realized and attained by means of the elements and combinations particularly pointed out in the appended claims.

It is to be understood that both the foregoing general description and the following detailed description are exemplary and explanatory only and are not restrictive of the embodiments, as claimed.

BRIEF DESCRIPTION OF THE DRAWINGS

The accompanying drawings, which are incorporated in and constitute a part of this specification, illustrate several embodiments and together with the description, serve to explain the principles of the embodiments.

DESCRIPTION OF THE EMBODIMENTS

Figure 1:
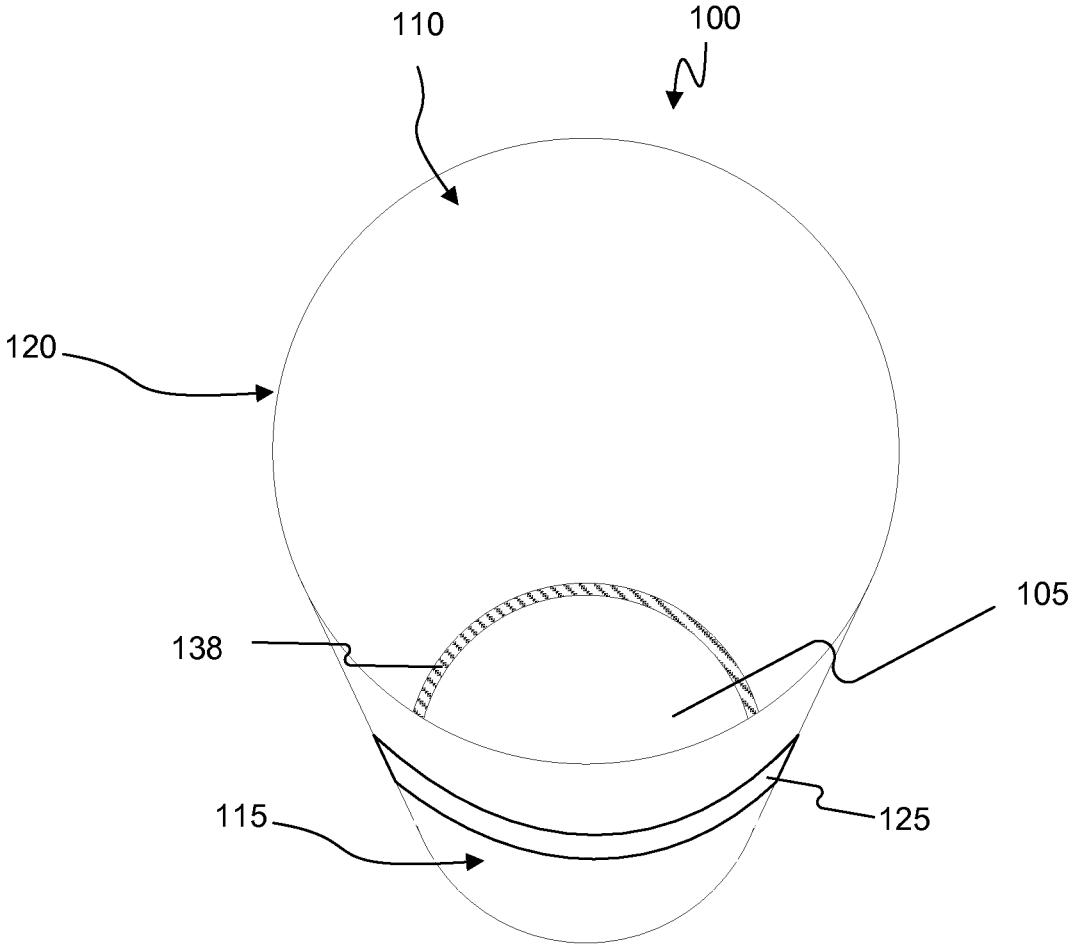
FIG. 1 illustrates a perspective view of an exemplary cup in accordance with an embodiment described herein.

Described below are exemplary embodiments including cups capable of coloring liquid poured into them, and methods for manufacturing these cups. In one embodiment, the cup contains a colorant fixed onto an inner wall of the cup (e.g., a side wall and/or a bottom wall). The colorant is predisposed to dissolve into a liquid, once a liquid is poured into the cup and immerses the colorant. In this way, when liquid is poured into the cup, the color of the liquid changes based on the colorant that is predisposed in the cup and subsequently immersed in the liquid. In one embodiment, the cups may be stackable without transferring the colorant from one cup onto another. This may, in one aspect, allow the cups to be packaged as disposable cups in large stacks.

Cups in accordance with an embodiment may be used to color alcoholic beverages, for example, at athletic events, parties, and on holidays, among other situations. The cups may also be useful in non-alcohol-related situations, such as at birthday parties, or in some situations in which a parent wishes to entice their child to drink something (e.g., water, juice, or milk). Other novelty uses are also possible.

The term "cup" includes any drinking container for holding a liquid, but a cap or a top is not part of the cup or container. Although a cup can be optionally fitted with a top in one embodiment, the top is not part of the cup and instead is a separate object. Additionally, as used herein, a "cup" requires a top opening that is larger in diameter than a bottom base of the cup, such that cups of identical dimensions can be stacked within one another. Therefore, a conventional bottle, which has a smaller opening than base, does not fall within the use of the term "cup" herein. On the other hand, the term "cup" can include any drinking container meeting the above requirements even if the container is not conventionally referred to as a cup.

The cups can be disposable in one embodiment. They can be made from paper, a polymer, plastic, or a recycled material. The cup can have an outer surface and an inner surface for holding the liquid, the inner surface including a side wall and a bottom.

As used herein, a colorant can comprise any chemical, compound, or dye used to color liquid without changing the taste of the liquid. For example, one or more of the following dyes can be used alone or in combination: annatto (E160b), chlorella algae (E140), cochineal (E120), turmeric (curcuminoids, E100), saffron (carotenoids, E160a), paprika (E160c), pandan (*Pandanus amaryllifolius*), and butterfly pea (*Clitoria ternatea*).

The colorant may, in one embodiment, be chosen specifically to color a particular type of liquid, such as beer, water, apple juice, milk, etc. For example, the amount of colorant needed to effectively color milk, which has an opaque white base, may be less that the amount of colorant needed to color water, which is clear. On the other hand, the amount of colorant needed to color beer, which has a transparent golden base, may be more than that of water. Greater amounts of colorant compound can cause more colorant to be dissolved, which can be used to create a darker color or to more quickly color the liquid. Those of ordinary skill in the art will appreciate that some compounds can dissolve more rapidly than others.

The rate of dispersion can be affected by the amount of exposed surface area of the colorant, the total amount of colorant, and the compound(s) that comprise the colorant. For example, the more exposed surface area that the colorant has, the more immediate contact it will have with liquid poured into the cup, and the more rapidly it may dissolve. The exposed surface area of colorant can be limited, for example, by placing the colorant in a recess. Conversely, greater surface area, which may correspond to a shorter time for dissolving, may be accomplished by dispersing the colorant along a substantial (e.g., more than half or entire) portion of the bottom surface 105 of the cup 100, and/or along the side wall 110 of the cup 100. For example, the cup 100 is depicted in FIG. 1 as containing less surface area of colorant 138 than in FIG. 3.

The colorant can begin dissolving (i.e., dispersing) in the liquid when the colorant comes in contact with the liquid. The colorant can be immersed by filling the cup to a level above the lowest portion of exposed colorant in one embodiment. In another embodiment, contact can occur when the liquid is poured directly on to the colorant.

FIG. 1 illustrates an exemplary embodiment that includes a cup 100 with colorant 138 fixed upon the inner wall 110 at the bottom 105 of the cup 100. In this example, the colorant 138 forms a ring shape along the bottom 105 of the cup, proximate to the bottom of the side wall of the cup. When a liquid, such as water, is poured into cup 100 and contacts colorant 138, the colorant 138 begins dissolving into the liquid.

The colorant 138 may be fixed onto the inner wall 110 (e.g., side wall or bottom 105) of cup 100. This can include, for example, impregnating the cup 100 with colorant in a recess specifically for holding the colorant, as explained in detail below.

The color of colorant 138 may be selected for particular applications in one embodiment. For example, cups with a red colorant could be sold for use at an Atlanta Falcons™ National Football League™ game or tailgate party, to represent the red team color. Additionally, the outer surface of the cup 100 may be imprinted with markings and/or graphics of various shapes and colors (including, for example, a picture, logo, or a stripe 125) to further compliment and/or enhance the color that the liquid becomes when added to the cup. For instance, a cup could be imprinted with one or more black stripes 125, so that the red liquid and black stripe(s) 125 represent both team colors of the Atlanta Falcons™. In one embodiment, logos and other designs may be provided on the exterior of the cup to further compliment the color that the colorant 138 causes the liquid to become.

The cups can be disposable in one embodiment. They can be made from one or more materials, including paper, a polymer, plastic, recycled products, or other materials used by those of ordinary skill in the art to make cups. These disposable cups may be sold in stacks. In one embodiment, each cup 100 in a stack contains colorant 138 of the same color. In another embodiment, at least two cups within the stack contain different-colored colorant 138. Different-colored colorant 138 can be used within the same stack and/or set of cups 100 to represent, for example: different colors of the same sports team, mystery colors for use at birthday parties, and other scenarios.

In one embodiment, the colorant 138 is disposed within the cup 100 such that an identically-dimensioned cup can be stacked within cup 100 without making contact with the colorant 138. This can allow stacks of multiple cups to be provided while minimizing the chances that colorant from cup 100 will rub off on the outer edge of a cup stacked within it. This, in turn, reduces the chances of any colorant 138 getting on the hands of someone drinking from a cup consistent with an embodiment herein. The minimized chance of mess is among several advantages of embodiments herein over traditional methods of coloring liquids that are poured into cups.

In order to ensure the colorant 138 does not touch the outer wall of a stacked cup, the colorant may be predisposed only on a portion of the inner surface that does not come into contact with the outer wall of a stacked cup. For example, returning to FIG. 1, the cup 100 can be dimensioned such that an identically-dimensioned cup will not contact colorant 138 when stacked within cup 100. This may be accomplished by using cup dimensions such that when the bottom of an identically-dimensioned cup is stacked within cup 100 it does not reach the bottom surface 105 of cup 100. Similarly, turning to FIG. 3, the colorant 138 may be affixed such that it does not extend far enough up the side wall 110 of cup 100 to touch an external wall 115 of an identically-dimensioned cup stacked inside cup 100.

Alternatively, continuing with FIG. 1, colorant 138 can be predisposed (i.e., affixed) within a recess in the inner wall of cup 100 to reduce the chance of contact with a stacked cup. In the example illustrated in FIG. 1, the colorant 138 is deposited within a ring-shaped recess at the bottom 105 of cup 100. However, other orientations are possible, such as orientations discussed with reference to FIGS. 3-4. For example, the colorant 138 can be formed in a disk shape, in a stripe, distinguishing marking (e.g., logo or word), or can even coat an entire inner portion of cup 100. Additional alternate colorant orientations are discussed in more detail below with reference to FIGS. 2A-4.

Figure 2A:
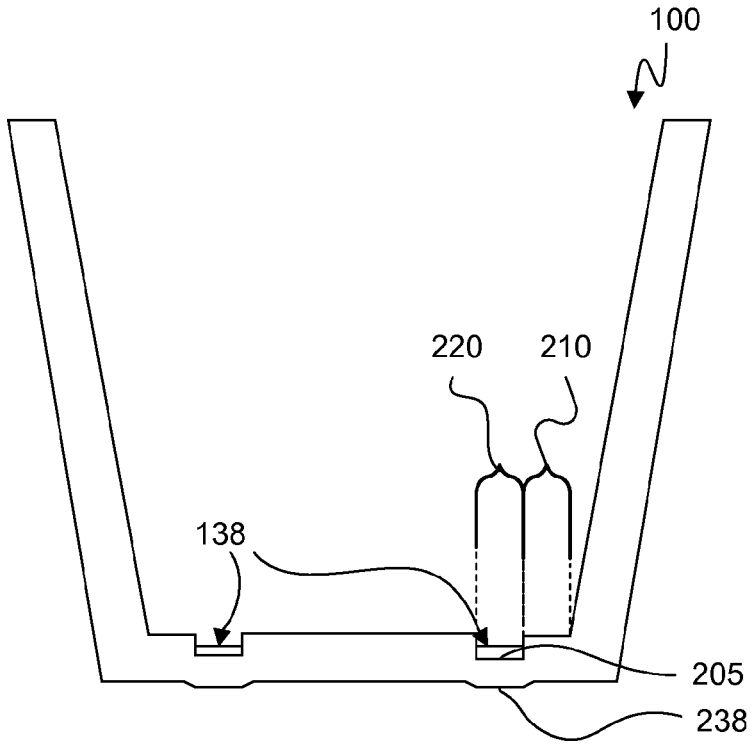
FIG. 2A illustrates a cross-sectional side view of an exemplary cup in accordance with an embodiment described herein.

Turning to FIG. 2A, a recess 205 is discussed. FIG. 2A illustrates a cross-sectional side view of an exemplary cup 100 in accordance with an embodiment described herein, wherein the colorant 138 is affixed to the cup 100 within the recess 205. In this example, the recess 205 forms a ring shape at the bottom of the cup 100. The cup may be impregnated with colorant within this recess 205, and, in one embodiment, the colorant may be applied to the recess at the time the recess is formed. Although a ring-shaped recess 205 is illustrated in this example, other recess shapes and orientations are possible. For example, the recess can be a disk shape, a stripe, or can spell a word or form a logo.

In one embodiment, the colorant 138 may be deposited on the inner wall 110 of cup 100 in the shape of a distinguishable marking, such as a logo, word, symbol, or picture. For convenience, a logo is referred to herein, but it is understood that these teachings also apply to other types of distinguishable markings. A logo-shaped colorant 138 may be located on the bottom 105 of the cup 100 in one embodiment. Alternatively, the logo-shaped colorant 138 may be located on the side wall of the cup 100 in one embodiment. In one aspect, the cup 100 can be transparent, such that the logo-shaped colorant 138 is visible from outside of the cup. Once liquid is poured into the cup, the colorant 138 may dissolve into the liquid, causing the logo or word to fade away.

The shape of the logo (or other distinguishable marking) may be defined by a recess 205 shaped like the logo, wherein the recess 205 is filled with the colorant 138. In one embodiment, by impregnating the cup 100 with colorant 138 within the logo-shaped recess 205, an identically-dimensioned cup can be stacked within cup 100 without contacting the colorant 138.

Continuing with FIG. 2A, the recess 205 may comprise an indentation on the bottom 105 of the cup 100. The indentation can be situated a distance 210 from the side wall of cup 100, and, in one embodiment, a corresponding bulge 238 can protrude from the bottom of the cup 100 opposite the recess 205. In one embodiment, the recess can have a smaller width 220 than the width of the corresponding bulge 238.

Figure 2B:
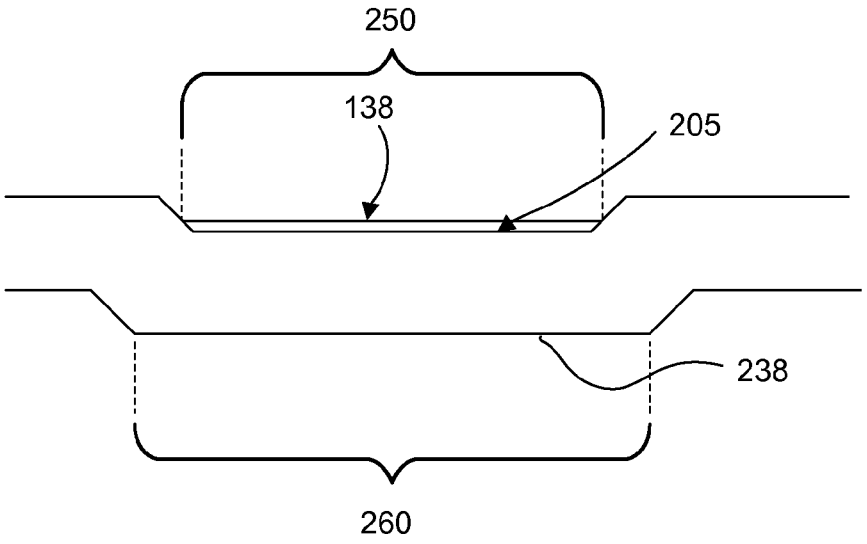
FIG. 2B illustrates a cross-sectional side view of the bottom of a cup in accordance with an embodiment described herein.

Similarly, FIG. 2B illustrates a cross-sectional side view of the bottom of a cup 100 in accordance with an embodiment described herein. As illustrated, at the level at which the colorant 138 is affixed, the width 250 of the recess 205 may be smaller than a smallest width of bulge 238, even if the top of the recess is not smaller than the smallest width of the bulge. This can prevent the bulge 238 from touching the colorant when identically-dimensioned cups are stacked within each other. In an alternate embodiment, no bulge 238 exists.

Figure 3:
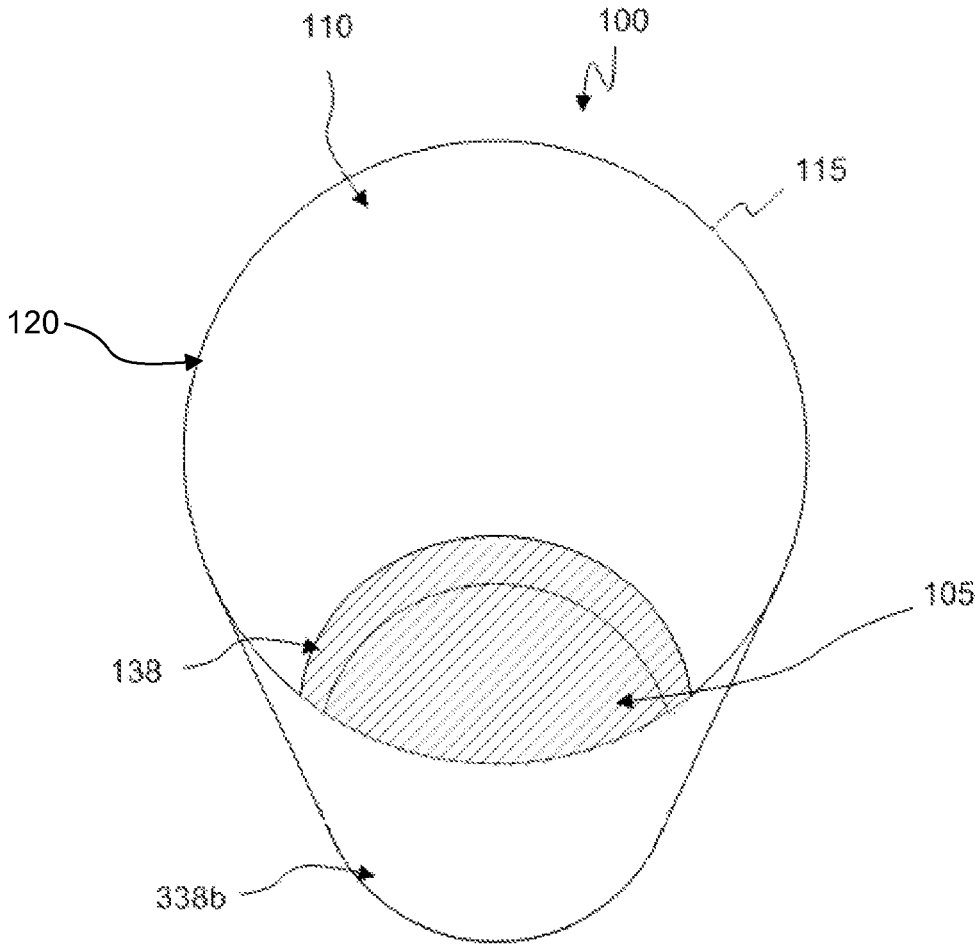
FIG. 3 illustrates a perspective view of an exemplary cup in accordance with an embodiment described herein.

FIG. 3 illustrates a perspective view of an exemplary cup in accordance with an embodiment described herein. In this example, colorant 138 is fixed to the bottom 105 and part of the inner wall 110 of the cup, although in another embodiment the colorant may be fixed to only the bottom 105 or inner wall 110 of the cup. The colorant may be fixed low enough in the cup that it does not contact the exterior of an identically-dimensioned cup stacked within the cup 100. For example, the colorant 138 may be affixed up to 1 centimeter of the side wall from the bottom 105 of cup 100.

In one embodiment, a logo (as described above), marking, phrase or word may be printed on the interior of the cup 100 and concealed by colorant 138, which may cover the logo or other marking. The logo or marking can then be exposed after the colorant 138 has dissolved in the liquid added to the cup and/or the liquid is consumed or removed from the cup. The application of the logo, marking, phrase or word could be used, for instance, in contests or giveaways or as a novelty at children's birthday parties. In this embodiment, a drinker may be eager to see what is beneath the colorant once it has dissolved and the colored liquid is consumed.

Figure 4:
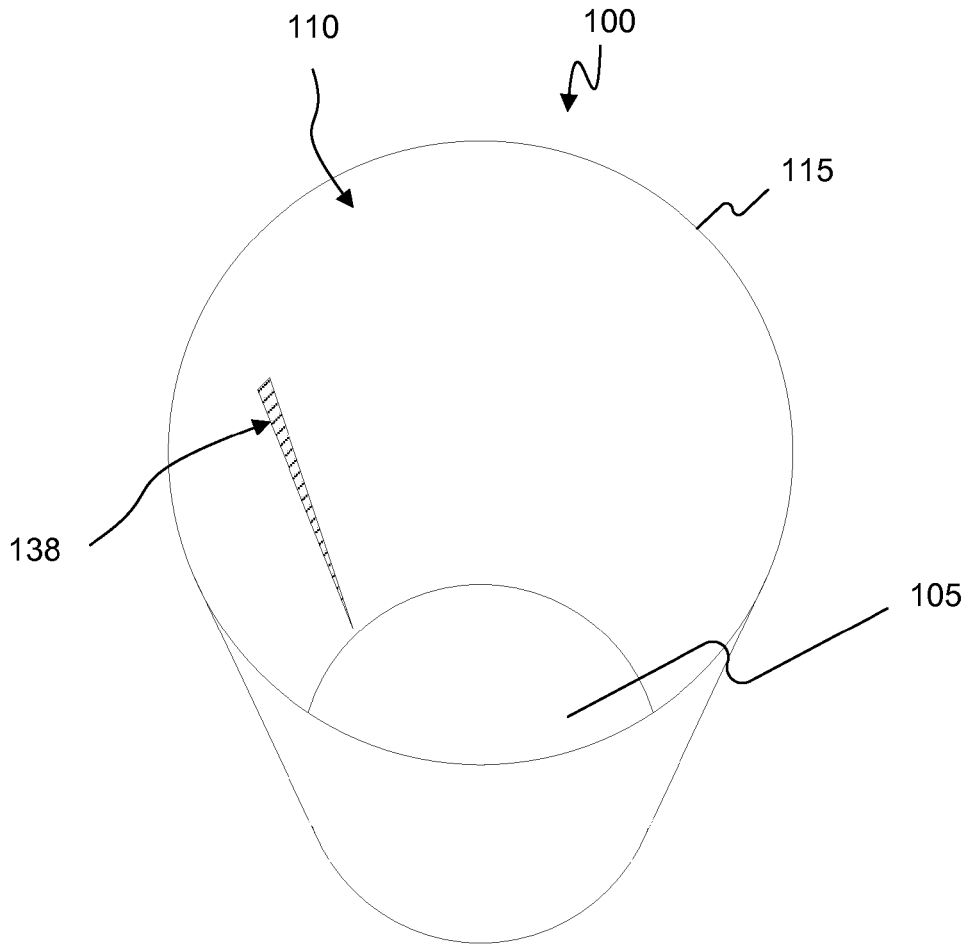
FIG. 4 is a perspective view of another exemplary embodiment of a cup disclosed herein.

FIG. 4 is a perspective view of another exemplary embodiment of a cup disclosed herein. In this example, the colorant 138 is oriented in a vertical stripe along the inner wall 110 of the cup 100, relative to the bottom 105. The colorant 138 may be affixed within a vertically-oriented recess in one embodiment.

In one aspect, the vertical recess can hold proportionally more colorant 138 towards the top of the recess than towards the bottom of the recess. This can be accomplished, for example, but forming a recess that is deeper and/or wider towards the top than towards the bottom. This may allow, in one embodiment, the colorant to color the liquid in a substantially uniform manner, even if the cup is not completely filled with liquid. Specifically, because the diameter of the cup 100 is greater towards the top of the cup than at the bottom 105, proportionally more colorant may be required to maintain substantially the same liquid color as the cup 100 is filled to higher levels. In this way, the colorant 138 towards the top of the vertical recess has more dying capacity than the colorant towards the bottom of the recess, since there is more colorant 138 towards the top. In another embodiment, the colorant 138 may have more dying capacity towards the top of the recess because the compound towards the top is a more potent and/or concentrated coloring agent, allowing proportionally the same amount of colorant to dye proportionately more liquid.

Additionally, multiple different colorants can be used in a single cup in one embodiment for various color effects. For example, FIG. 5 illustrates a cross-sectional side view of the bottom of a cup having a colorant that comprises multiple colors, in accordance with an embodiment described herein.

In one embodiment, a bottom (i.e., first) colorant **538*b* may be affixed to the bottom wall 509 of the recess 505. In one embodiment, the bottom colorant 538*b* may be held in the recess 505 by the outer walls of the recess 505, such as by tapering the outer walls so that the recess 505 is wider at the bottom 509 than at the top 507. A top (i.e., second) colorant 538*a* may be affixed and/or placed over the top of the first colorant 538*b*. In one embodiment, the top colorant 538*a* is applied after the bottom colorant 538*b* has already been affixed within the recess 505**.

Figure 5:
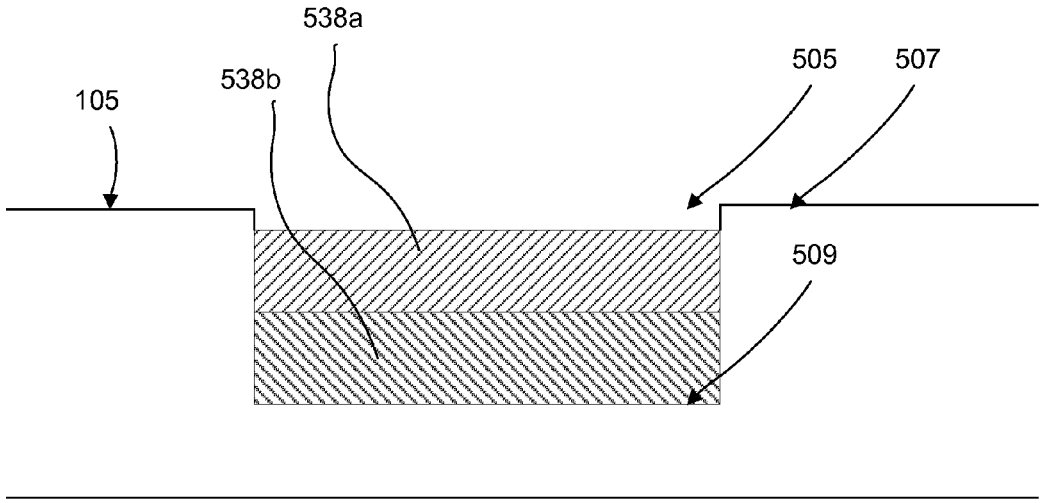
FIG. 5 illustrates a cross-sectional side view of the bottom of a cup having a colorant that comprises multiple colors, in accordance with an embodiment described herein.

Continuing with the example of FIG. 5, when liquid is added to the cup 100, the top colorant **538*a* may dissolve and color the liquid. After some portion of the top colorant 538*a* has dissolved, the bottom colorant 538*b* is exposed to the liquid. At that point, the bottom colorant 538*b* will begin dissolving into the liquid, causing the liquid at the bottom 105 of the cup 100 to change color or be imparted with a different color characteristic. The mixing of the first colorant 538*b* and the second colorant 538*a* may cause the liquid in the cup to turn a new color that results from the combination of the different colors provided by colorants 538*a* and 538*b* in one embodiment. In another embodiment, the bottom colorant 538*b* may dominate the top colorant 538*a*. For example, the top colorant 538*a* may cause the drink to initially turn red, and then the bottom colorant 538*b*** may cause the drink to turn black. Such time delayed colorants can be used for example, to represent different team colors, or be used in drinking games. In still another embodiment, different colorants may cause different colors to diffuse into the liquid that remain localized at different portions of the cup (e.g., red at the top and black at the bottom).

Other multi-color configurations are possible in various other embodiments. For example, two different colorant tablets may be fixed to different recesses of the cup 100 in one embodiment. It is possible that one colorant can be predisposed to absorb more quickly than the other, such that the liquid first is dyed a first color, and then is gradually dyed a second color over time.

Figure 6:
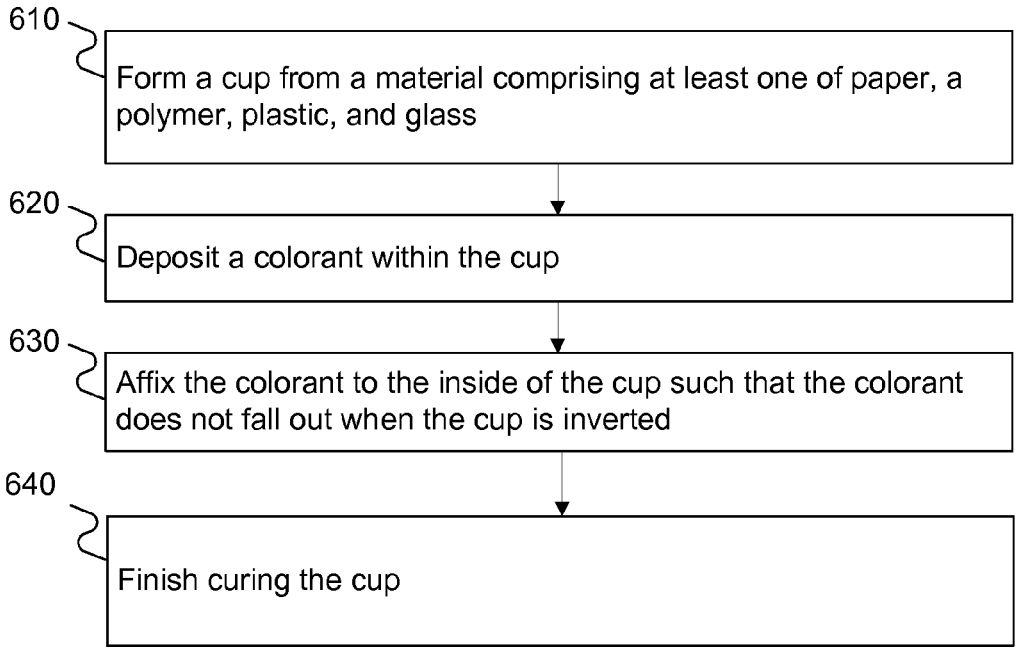
FIG. 6 is a flow chart including exemplary steps performed in accordance with an embodiment described herein.

FIG. 6 is an example flow chart including exemplary steps performed in accordance with a manufacturing embodiment described herein. In step 610, a cup is formed from a material comprising at least one of paper, a polymer, plastic, and recycled products. In one embodiment, mold plates are used to form a clear plastic cup that contains a recess for receiving colorant. The cups can be dimensioned such that identically-dimensioned cups do not touch colorant in the recess when the cups are stacked within each other. For example, the mold plates may cause the exterior of the cup to not protrude down into the recess of another identically-dimensioned cup when the cups are stacked.

At step 620, a colorant is deposited within the cup. This may be accomplished mechanically and/or automatically. For example, a machine may deposit the colorant into the recess that is formed within the cup, thereby impregnating the cup with the colorant. The colorant may be deposited as a wafer that fits the dimensions of the recess in one embodiment. In another embodiment, the colorant may be sprayed or dropped in liquid form into the recess, where it solidifies.

In another embodiment, a liquid form of colorant 138 may be applied onto the inner wall of the cup 110 and/or the bottom of the cup 105 through a fluid spray nozzle. This approach may be used, for example, to achieve the cup 100 of FIG. 3. The coating of colorant 138 may be applied in varying thicknesses depending on the specific intensity of color desired in the liquid added to the cup. The colorant 138 may be affixed at least 1 inch away from the top of the cup 120. The colorant 138 may be affixed to the inner wall of the cup 110 and/or the bottom of the cup 105 using a dissolvable adhesive that is safe for human consumption. After application, the colorant 138 may be allowed to cure and/or dry so that the colorant 138 becomes dry to the touch and permanently affixed within the confines of the inner wall of the cup 110 and/or the bottom of the cup 105 until a liquid is added.

At step 630, the colorant is affixed to the inside of the cup such that the colorant does not fall out when the cup is inverted. In one embodiment, this includes applying a tasteless sticky adhesive to a portion of a colorant tablet that comes into contact with the cup. In another embodiment, the colorant is pressed into a recess that is dimensioned appropriately to hold the colorant in place. This can be achieved, for example, by molding the recess to be smaller at the opening than at the bottom of the recess. The colorant may be pressed into such a recess in one embodiment, or injected in liquid form and allowed to dry within the recess in another embodiment. In a further embodiment, heat or air may be applied to the liquid colorant to cause it to dry within the cup.

In one embodiment, at step 640, the process includes finishing the curing of the cup after the colorant is added. This can, for example, cause a polymer lining of the cup to bond with the colorant, holding the colorant in place.

In another embodiment, the colorant is not added to the cup until after the cup is fully cured.

Other embodiments will be apparent to those skilled in the art from consideration of the specification and practice of the embodiments disclosed herein. It is intended that the specification and examples be considered as exemplary only, with a true scope and spirit of the embodiments being indicated by the following claims.

What is claimed is:

1. A cup for coloring a liquid that is poured into it, the cup comprising:

an outer surface;

an inner surface for holding the liquid, the inner surface including a side wall and a bottom; and a colorant fixed on the inner surface of the cup before the addition of the liquid to the cup, the colorant being located on the bottom of the inner surface in a ring shape such that a top portion of the colorant is exposed, wherein the colorant is exposed between a first point outside the ring shape and a second point on the bottom of the cup within the ring shape, wherein the colorant is preconditioned to dissolve when contacting the liquid, and wherein a top surface of the bottom defines a first plane that includes the first point outside the ring shape and the second point within the ring shape, the colorant being located in a recess and a top surface of the colorant defining a second plane, the second plane defined by the colorant being lower than the first plane defined by the top surface of the bottom, and wherein the cup will stack within a second identically-dimensioned cup.

2. The cup of claim 1, wherein the outer surface is at least partially transparent, allowing a person to view the colorant through the outer surface without looking down into the cup relative to the bottom.

3. The cup of claim 1, wherein the ring shape is formed at the bottom of the cup along the side wall.

4. The cup of claim 3, wherein the second identically-dimensioned cup includes a second colorant that is a different color than the colorant in the cup.

5. The cup of claim 1, wherein the recess in the inner surface is opposite of a bulge in the outer surface, wherein the minimum width of the bulge is greater than the maximum width of the opening of the recess.

6. The cup of claim 1, further comprising a first color on at least a portion of the outer surface, wherein the colorant is a second color different from the first color, and the first color and second color represent colors of a sports team.

7. The cup of claim 1, wherein the colorant comprises at least first and second colors, wherein the first color is positioned to substantially completely dissolve into liquid poured into the cup prior to the second color beginning to dissolve into the liquid.

* * * * *